United States Patent [19]

Seragnoli

[11] 4,188,024

[45] Feb. 12, 1980

[54] DEVICE FOR FOLDING SHEET MATERIAL INTO HINGED LID PACKETS

[75] Inventor: Enzo Seragnoli, Bologna, Italy

[73] Assignee: G. D. Societa per Azioni, Bologna, Italy

[21] Appl. No.: 791,281

[22] Filed: Apr. 27, 1977

[30] Foreign Application Priority Data

May 6, 1976 [IT] Italy ..... 3423 A/76

[51] Int. Cl.[2] ..... B65H 45/18

[52] U.S. Cl. ..... 270/67; 270/80

[58] Field of Search ..... 270/67, 93, 80–85; 93/39 R, 40, 41, 49 R, 49 M, 84 R

[56] References Cited

U.S. PATENT DOCUMENTS 2,349,056 5/1944 Serai ..... 270/93

FOREIGN PATENT DOCUMENTS 998082 7/1965 United Kingdom ..... 270/93

1198914 7/1970 United Kingdom ..... 270/83

*Primary Examiner*—Paul T. Sewell
*Assistant Examiner*—A. Heinz
*Attorney, Agent, or Firm*—H. Dale Palmatier

[57] ABSTRACT

A device for folding preshaped pieces of cardboard advancing in a stepped manner along a support surface and towards an intermittent machine for packaging cigarettes into hinged lid packets, the device including folding means arranged at a folding position along said support surface to fold a peripheral portion of that of said pieces which is arranged at said folding position about a preshaped folding line parallel with said advancement direction and coinciding with a free lateral edge of a folding bar coplanar with said support surface, said folding means being disposed facing said free edge and being movable to engage said peripheral portion to bend the same underneath said folding bar about said free edge.

3 Claims, 7 Drawing Figures

DEVICE FOR FOLDING SHEET MATERIAL INTO HINGED LID PACKETS

BACKGROUND OF THE INVENTION

This invention relates to a device for folding sheet material for feeding to a user machine.

In particular, the present invention relates to a device for folding preshaped or punched pieces of cardboard or the like for feeding to a machine for packaging cigarettes into hinged lid packets, and is particularly adapted to constituting a folding station for a conveyor feeding said preshaped or punched pieces to said machine.

For feeding preshaped packaging pieces to said packaging machines and in particular to intermittent packaging machines, stepwise conveyors are notably used along which said preshaped pieces are subjected to at least one folding operation on a predetermined folding line.

The main object of this operation is not generally to give said preshaped pieces a three-dimensional shape, but to fold and glue below the preshaped pieces at least one peripheral portion thereof in order to strengthen certain parts.

In particular, in hinged lid cigarette packets, the part generally strengthened by folding back and glueing a peripheral portion or flap is the front wall of the lid, which is substantially the only part of the packet subjected to stress during the opening and closing thereof.

In the aforesaid conveyors, said flap is folded over a predetermined part of the feed path for the preshaped pieces by making these cooperate with a fixed folding element of helex shape which progressively folds said flap under the relative preshaped piece, about a predetermined folding line.

Folding a peripheral flap of a preshaped piece by a helical folding element gives rise to numerous difficulties which result in poor fold accuracy and the formation of wrinkles on the folded preshaped piece, arising mainly from the fact that the fold is necessarily made on a preshaped piece under movement and is not made at the various points along the folding line simultaneously, but rather in succession. These disadvantages may be ignored when the feed frequency of the preshaped pieces is below a relatively low value, but become unacceptable at very high frequencies, for example of the order of seven steps per second or more, corresponding to the frequency required for feeding a modern intermittent packaging machine.

SUMMARY OF THE INVENTION

The object of the present invention is to provide a folding device free from the aforesaid disadvantages which enables preshaped packaging pieces to be folded with extreme accuracy even at very high feed frequencies.

Said object is attained according to the present invention by a device for folding sheet material, particularly preshaped or punched pieces of cardboard or the like for feeding to an intermittent machine for packaging cigarettes into hinged lid packets, said device being of the type comprising a support and slide surface for said preshaped pieces, stepwise feed means for feeding the preshaped pieces at each step into determined positions in a determined direction along said surface, and folding means arranged to cooperate in succession with each said preshaped piece to fold a peripheral portion thereof extending outwards from a predetermined folding line parallel to said feed direction; and further comprising a folding bar disposed at one of said determined positions and constituted by a fixed plate coplanar to said surface and extending therefrom in a direction parallel to said feed direction, and abutment means arranged to cooperate with an end of said preshaped pieces lying opposite said peripheral portion to bring said folding line into a position coinciding with a free external edge of said bar; said folding means being disposed facing said free edge of said bar and comprising a rod substantially parallel to said bar and perpendicular to said feed direction, first means operable in parallel with said stepwise feed means to move said rod in a direction substantially perpendicular to said feed direction between a rest position above said bar and a working position below it, second means operable in parallel to said stepwise feed means to move said rod in a substantially axial direction between a rest position external to said bar and a working position in which an end portion of said rod becomes positioned below said bar, and mobile fixing means for fixing each preshaped piece in said determined position against said bar during the folding of the relative end portion.

Preferably, said rod comprises a transverse appendix arranged to engage, under the action of said second movement means, with a free end edge of the peripheral portion of the preshaped piece disposed in said determined position to thrust this latter against said abutment means.

The folding of said peripheral portion of the preshaped pieces by the aforesaid device is extremely precise both because it is carried out when the preshaped pieces are at rest between one step and another in the said determined position, and because a positive contour is used for folding, i.e. a folding bar about which said peripheral portion is folded.

BRIEF DESCRIPTION OF THE DRAWINGS

Further characteristics and advantages of the present invention will be evident from the description given hereinafter with reference to the accompanying drawings which illustrate one non-limiting embodiment thereof, and in which.

DETAILED DESCRIPTION OF THE INVENTION

Figure 1:
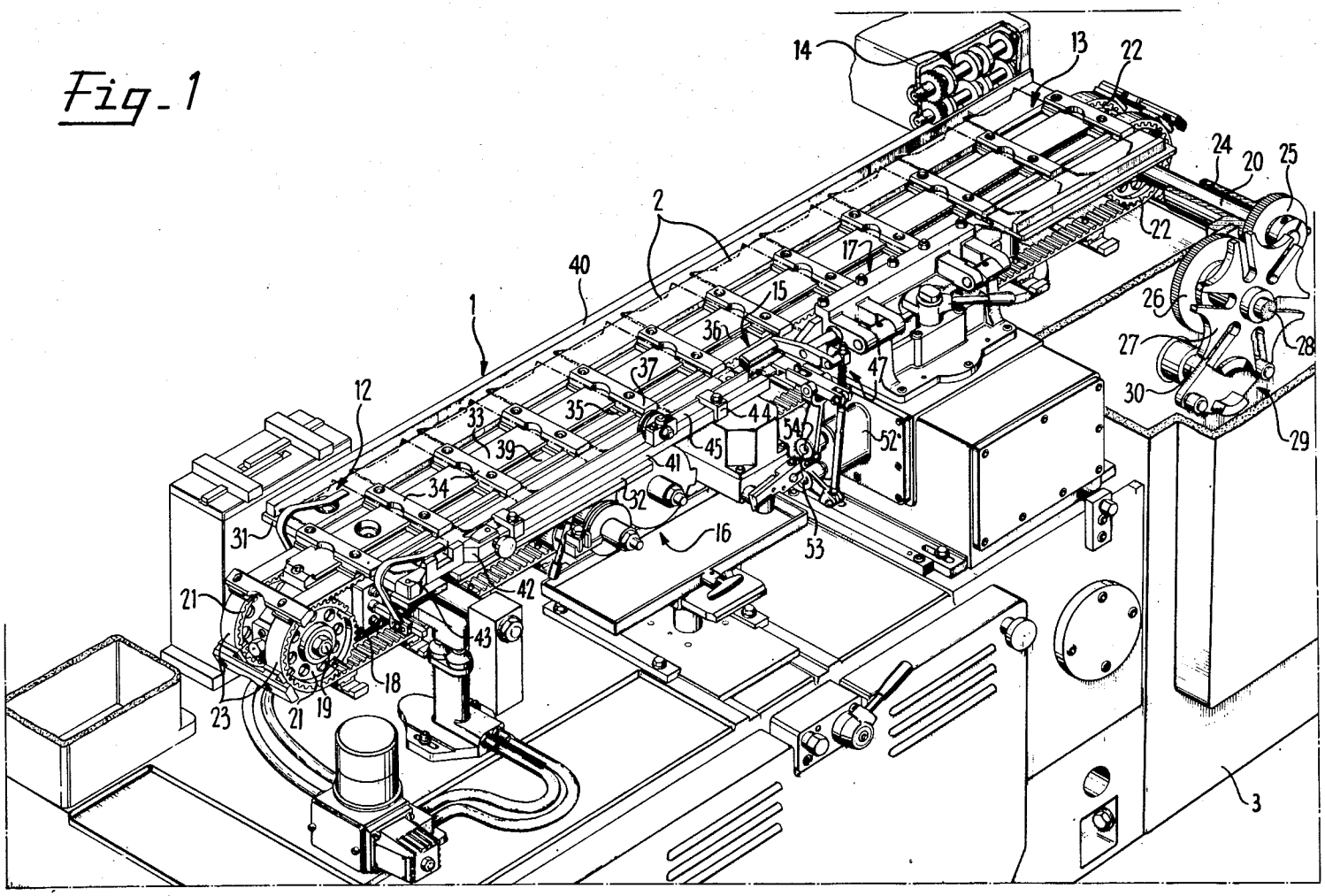
FIG. 1 is a three-quarter perspective view from above of a conveyor comprising a folding device constructed in accordance with the present invention.

FIG. 1 shows a conveyor 1 for use in feeding preshaped packaging pieces or workpieces 2 to an intermittent machine for packaging cigarettes into hinged lid packets.

Figure 2:
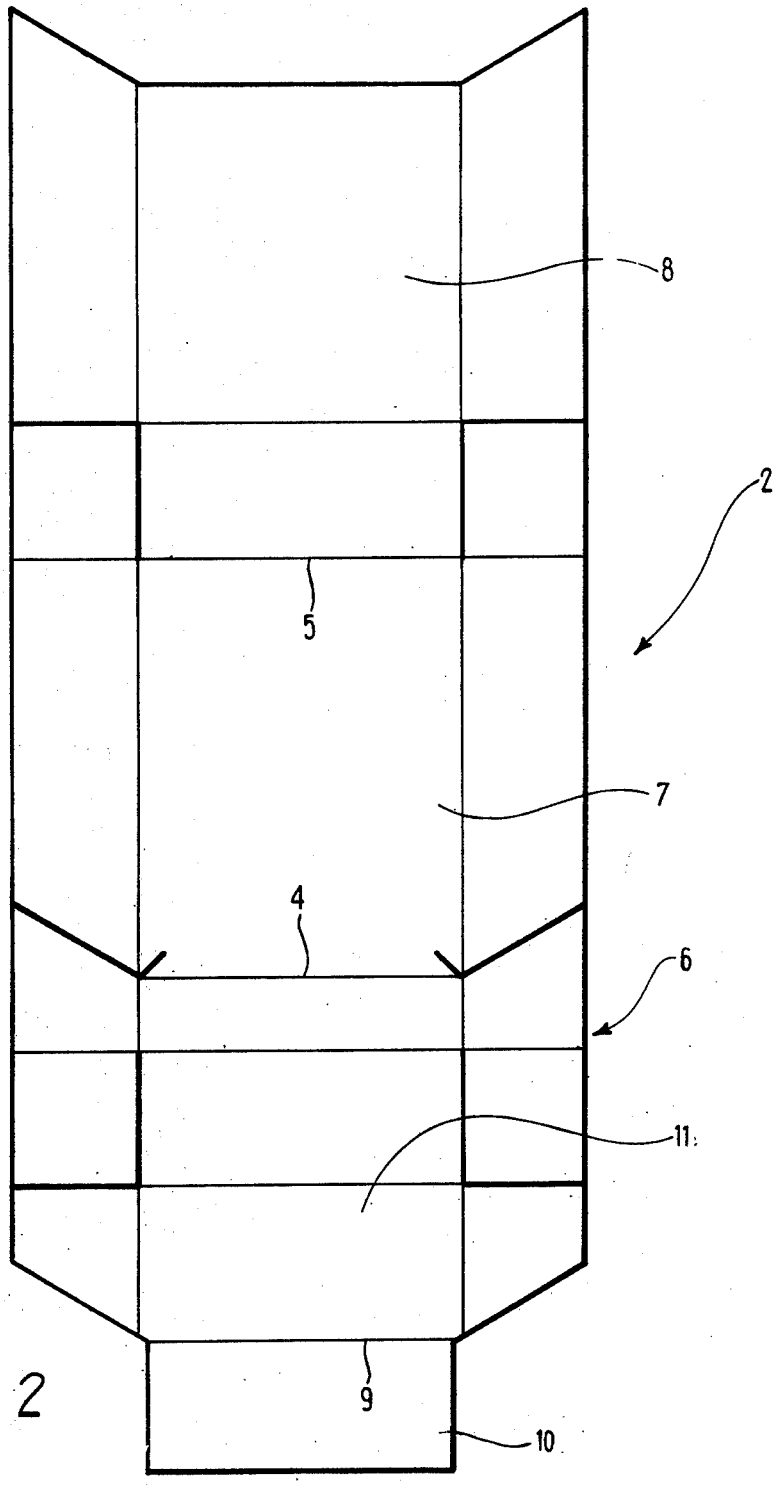
FIG. 2 is a plan view of a preshaped piece fed by the conveyor shown in FIG. 1 to a packaging machine.

As shown in FIG. 2, the preshaped piece 2 is divided by two folding lines 4 and 5 into three portions 6, 7 and 8, the first of which is to be folded along further folding lines to form a lid of a hinged lid packet. On the portion 6, a folding line 9 defines a terminal flap 10 to be folded and glued on to a portion 11 adjacent thereto to constitute a reinforcement for the lid of said packet.

The conveyor 1 is of the type described and claimed in U.S. patent application Ser. No. 791,327, filed April 24, 1977, of the same applicant, and extends in a substantially horizontal direction above a base 3 between an inlet station 12 and an outlet station 13.

At the station 13 (for a detailed description of which reference should be made to U.S. patent application Ser. No. 791,282, filed Apr. 12, 1977, of the same applicant), the preshaped pieces 2 are transferred on to a second conveyor 14 connected to said intermittent packaging machine (not shown).

At a point along the conveyor 1 there is disposed a folding station 15 at which the flap 10 is folded along the folding line 9 and under the adjacent portion 11. The station 15 is preceded by a station 16 (for a detailed description of which reference should be made to Italian Pat. No. 997,144 of the same applicant corresponding to U.S. Pat. No. 3,987,753), at which the lower surface of the flap 10 is gummed, and is followed by a pressing station 17 at which the gummed and folded flap 10 is pressed against the lower surface of the adjacent portion 11. The conveyor 1 comprises a longitudinal member 18 disposed in a substantially horizontal position above the base 3, and supporting (at its ends) two shafts 19 and 20 disposed horizontally and transversely to the axis of the longitudinal member 18.

On the two ends of the shaft 19 there are rotatably mounted two gear wheels 21, each of which supports and engages, together with a corresponding gear wheel 22 keyed on the shaft 20, with a respective endless toothed belt 23 extending parallel to the axis of the longitudinal member 18.

One end of the shaft 20 extends rotatably through a sleeve 24 rigid with the base 3 and comprises keyed thereon a gear wheel 25, which engages with a gear wheel 26 rigid and coaxial with a Maltese cross 27 mounted rotatably on a shaft 28 carried by the base 3. A device of known type 29 mounted on the drive shaft 30 rotates the Maltese cross 27 intermittently or stepwise, and hence rotating the gear wheels 22 and belt 23 in a like manner via the shaft 20. Two flat plates 31 and 32 are connected laterally to the longitudinal member 18, to extend along it and project laterally therefrom in opposing transverse directions, and a longitudinal beam 33 is connected to the centre of the member 18 and comprises upperly a flat surface coplanar with the upper flat surfaces of the plates 31 and 32, to constitute with these latter two surfaces a support surface for the preshaped pieces 2.

Each of these letter is disposed in a respective conveying compartment defined by two tie bars 34 extending transversely above the beam 33 and connected at their ends to the belts 23 via guide shoes 35. Each shoe 35 comprises laterally a flat surface disposed in contact with a lateral flat surface of the beam 33, and a substantially rectangular lateral appendix slidably engaged in a respective longitudinal lateral groove 36 in the beam 33.

The transverse position of the belts 23 and relative tie bars 34 is controlled both by the shoes 35 and by a lateral appendix 37 provided with a tooth 38 extending into a longitudinal groove 39 provided in the upper surface of the plate 32.

The transverse position of the preshaped pieces 2 in the relative conveying compartments is controlled on one side by a guide rib or shoulder 40 connected to the upper surface of the plate 31, and on the other side by a guide rib or shoulder 41 connected to the upper surface of the plate 32.

The guide shoulder or abutment 40 extends longitudinally along the entire plate 31, while the guide shoulder 40 extends over that portion of the conveyor 1 between the inlet station 12 and folding station 15. At the station 12, the shoulder 41 is replaced by a control gate 42 mounted rotatably on a pin 43 supported by the plate 32. In order to prevent the preshaped pieces 2 from becoming detached vertically from the plates 31 and 32 and beam 33, brackets 44 are connected to the shoulder 41 to project above the plate 32 and support a vertical guide knife 45 extending over that portion of the conveyor 1 between the stations 12 and 15.

As shown in FIGS. 3 to 6, the plate 32 comprises at the folding station 15 a lateral recess along part of which a plate 46 coplanar upperly with the plate 32 extends.

The plate 46 comprises externally a straight edge parallel to the feed direction of the preshaped pieces 2, and arranged such that it is disposed directly under the folding line 9 of a preshaped piece 2 disposed on the station 15, the free end of its portion 8 being in contact with the guide rib 40. The plate 46 is arranged to cooperate with a folding unit or device 47 to constitute a bar for folding the flap 10 about the line 9 towards the lower surface of the adjacent portion 11.

The folding unit 47 comprises two drum cams 48 and 49 and a disc cam 50 keyed on to a single vertical shaft 51 supported rotatably by the base 3 and connected to the drive motor 30 via transmission means, not shown.

On the base 3 there is also mounted a support 52 from which two superimposed horizontal pins 53 and 54 extend parallel to the feed direction of the preshaped pieces 2 along the conveyor 1. On the pin 53 there is pivoted a rocker arm 55 comprising two substantially parallel arms 56 and 57, the first of which is provided with a support pin 58 for a cam following roller (not shown) mounted in an annular groove 59 formed on the outer surface of the cam 49, while the second arm 57 is connected via a hinge 60 to the lower end of a connecting rod 61. On the pin 54 there is pivoted a rocker arm 62 comprising two substantially perpendicular arms 63 and 64, the first of which is substantially parallel to the arm 56 and is provided with a pin 65 for supporting a cam following roller (not shown) mounted in an annular groove 66 provided on the outer surface of the cam 48, while the second extends upwards and is connected via a hinge 67, of axis parallel to the axis of the pins 53 and 54, to an intermediate point on a rocker arm 68, one end of which is connected via a hinge 69 to the upper end of the connecting rod 61.

The other end of the rocker arm 68 extends towards the plate 46 above the arms 56 and 63, and comprises connected thereto, in a position which is axially adjustable by a connecting screw 70, a holding rod 71 parallel and substantially coaxial to the rocker arm 68. Rod 71 has a downwardly facing folding face adjacent the end thereof. An appendix 72 substantially perpendicular to the rod 71 extends downwards from an intermediate point on the rod 71, and has a pusher face confronting plate 46 and abutment or guide 40, and will engage the edge of workpiece 2. The disc cam 50 comprises an annular cam surface 73 facing the cams 48 and 49 and engaged by a cam following roller 74 mounted rotatably on a pin 75 extending radially from the lower end of a vertical shaft 76 mounted to slide axially against the action of a spring 77, through a sleeve 78 rigid with the base 3.

The upper end of the shaft 76 is rigidly connected to an intermediate point on a horizontal plate 79 extending towards the plate 32 and disposed downstream of the plate 46.

To the lower surface of the plate 79 there is connected a vertical rod 80 extending downwards and mounted to slide along a hole 81 to prevent rotation of the shaft 76 in the sleeve 78. On that end of the plate 79 facing the plate 32 there is disposed a block 82 constituting the mobile element of the station 17 and arranged to cooperate with a fixed abutment 83, preferably heated by an electrical resistance heater, not shown, to pinch the preshaped pieces downstream of the station 15 and press their folded flap 10 against the relative adjacent portion 11. To that end of the plate 79 opposite the plate 32 there is connected, via a hinge 84 of axis parallel to the pins 53 and 54, the lower end of a tie rod 85 the other end of which is mounted to slide axially against the action of a spring 86, through a sleeve 87 hinged to one end of a rocker arm 88 pivoted on a pin 89 parallel to the pins 53 and 54 and disposed directly above the plate 71. That end of the rocker arm furthest from the end carrying the sleeve 87 supports a block 90 disposed above the plate 46 and arranged to cooperate with the upper surface of the portion 11 of each preshaped piece 2 during the folding of the flap 10.

Figure 7:
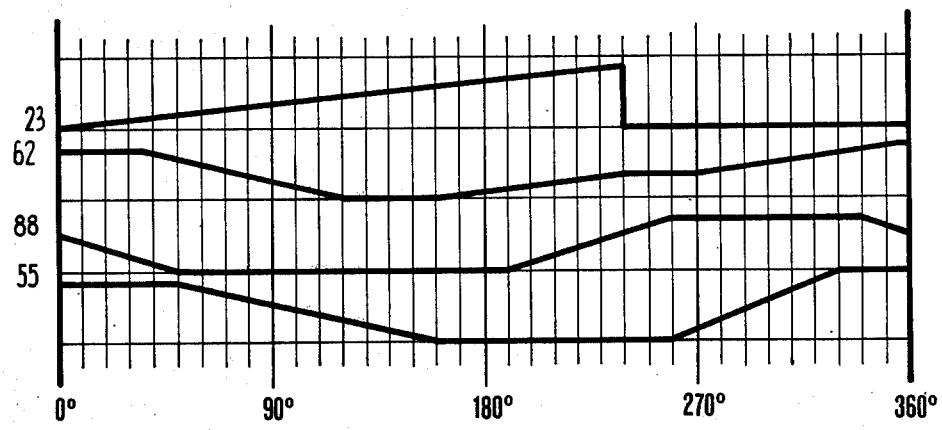
FIG. 7 shows time-phase diagrams for some mobile elements of the folding device shown in FIGS. 3 to 6.

The operation of the mobile elements of the folding station 15 is now described with reference to the operating diagrams of FIG. 7. These diagrams, distinguished by the reference number of the mobile elements to which they refer, illustrate the movements made by the elements 23, 62, 55 and 88 during one working cycle of the conveyor 1 commencing from the moment in which the device 29 operates the Maltese cross 27 so as to make it rotate, i.e. from the moment in which the belts 23 begin a feed step, as a result of which a folded preshaped piece 2 is evacuated from the station 15 and a new piece 2 to be folded is fed on to the plate 46.

During a first part of the feed movement of the new preshaped piece 2, the rotation of the cams 48 and 49 causes an upward movement of the relative cam following rollers, corresponding to a rotation (in the clockwise direction of FIGS. 3 to 6) of the rocker arms 55 and 62, at the same time causing the rod 71 to rise and become removed from the plate 46.

Figure 3:
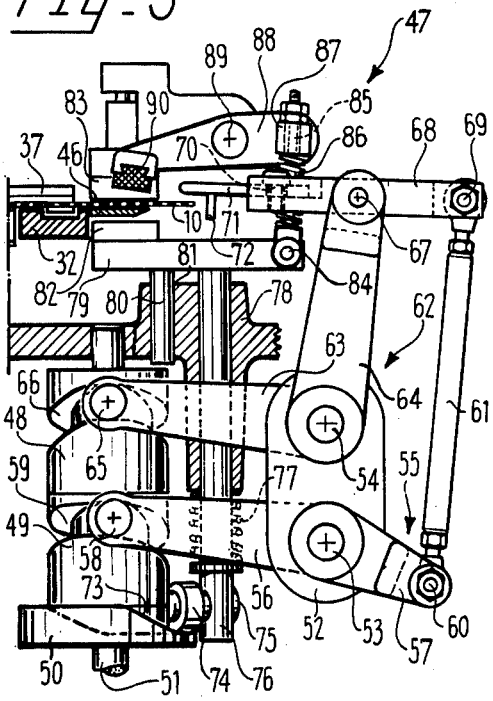
FIGS. 3, 4, 5 and 6 are partially sectional views to an enlarged scale, with parts removed for clarity, showing the folding device according to the invention at four different moments in its operation.

This upward and outward movement of the rod 71 terminates when it reaches the position shown in FIG. 3, in which the rod 71 is disposed at a level higher than that of the plate 46 and the appendix 72 is disposed outside the outer edge of the flap 10 of the preshaped piece 2 moved on to the plate 46. The position shown in FIG. 3 is reached when the belts 23 have made approximately one half of their stepwise movement. Subsequently, while the cam 49 keeps the rocker arm 55 in a substantially constant angular position, the cam 48 rotates (anticlockwise in FIGS. 3 to 5) the rocker arm 62, with a corresponding straight movement of the rod 71 towards the plate 46 until the appendix 72 is engaged with the lateral edge of the flap 10 of the preshaped piece 2, so as to urge and thrust and keep this latter perfectly in contact with the guide rib or abutment 40 and so exactly define its transverse position on the conveyor 1.

This transverse positioning, which takes place as soon as the belts 23 stop, is necessary in order to make the folding line 9 of the preshaped piece 2 perfectly coincide with the outer lateral edge of the plate 46. Simultaneously with the rotation of the rocker arm 62, the cam 50 causes an upward movement of the cam following roller 74 and correspondingly of the shaft 76 against the action of the spring 77.

This upward movement is transmitted, via the plate 79 and tie rod 85, to the outer end of the rocker arm 88, the other end of which moves downwards to make the block 90 squeeze the preshaped piece 1 against the plate 46.

Figure 4:
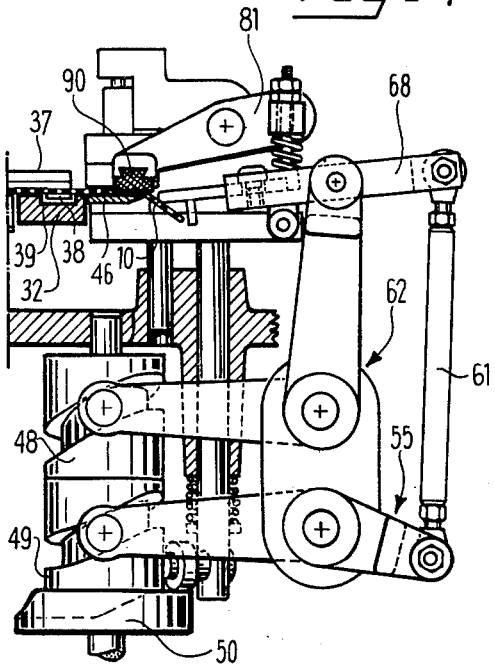
Figure 5:
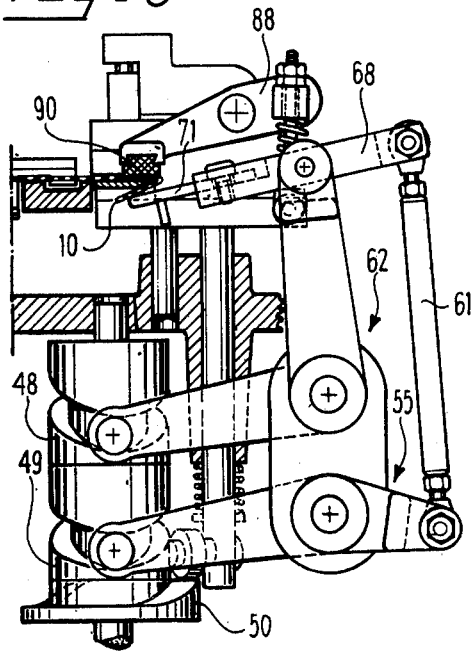
Figure 6:
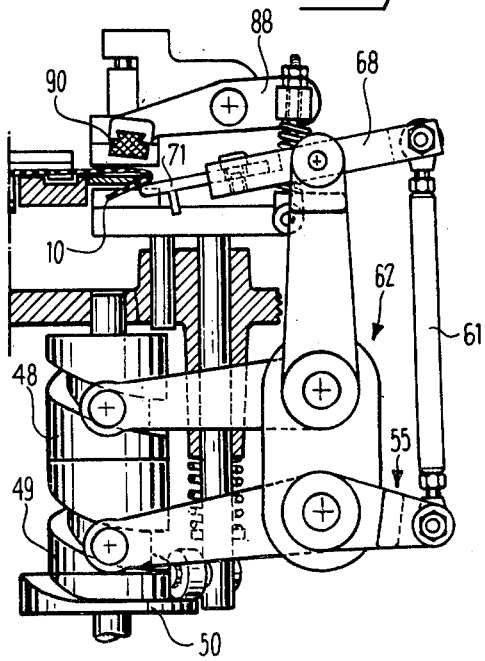

Consequently, immediately after the bolts 23 stop, the preshaped piece 2 disposed on the station 15 is perfectly positioned transversely by the appendix 72 and fixed in this position by the block 90. At this point the cams 48 and 49 rotate the relative rocker arms 62 and 55 (clockwise in FIGS. 3 to 6), as a result of which the free end of the rod 71 moves downwards towards the plate 46, passing under this latter as shown in FIGS. 4 and 5. During this movement, the rod 71 rests firstly on the flap 10 to fold it at a right angle downwards about the free end of the plate 46, and then thrusts it under the plate 46 to complete its folding. The block 90 which was in contact with the preshaped piece 2 during its entire folding is now moved upwards by the descent of the shaft 76 under the action of the cam 50, while the rod 71 is moved outwards (see FIG. 6) and upwards by the simultaneous action of the cams 48 and 49. At this point, the belts 23, which had remained at rest during the entire folding time, now resume their motion and the aforesaid working cycle is repeated.

It should be noted that in contrast to known conveyors, the flap 10 of the preshaped pieces 2 is not folded during the feed movement of the preshaped pieces 2 as a consequence of their engagement with helical folding contours, but instead is folded while the preshaped pieces 2 are at rest, about a folding bar constituted by the plate 46 the presence of which ensures precise folding of the flaps 10 about their relative folding lines 9.

Within the scope of the inventive idea, numerous modifications are possible to the described conveyor without leaving the scope of the present invention. For example, the two movements of translation and rotation of the rod 71 necessary for folding the flap 10 under the plate 46 could be obtained using means different from those described. For example, the articulated parallelogram formed by the rocker arms 55 and 68, the connecting rod 61 and a hinged frame comprising the support 52 and the arm 64 of the rocker arm 62, could be replaced by a slide mobile horizontally to and from the plate 46 and supporting the rocker arm 68 either rotatably about an axis parallel to the feed direction of the preshaped pieces 2, or mounted on a vertically mobile slide on said horizontal slide.

What I claim is:

1. A device for folding sheet material, particularly folding peripheral flaps of preshaped or punched pieces of cardboard or the like along a predetermined fold line, said device comprising a support with a slide surface for said preshaped pieces, intermittently operating feed means for feeding the preshaped pieces in a predetermined direction along said slide surface and cyclically stopping such preshaped pieces at predetermined positions, said feed means carrying the preshaped pieces with the fold line oriented approximately in the direction of travel, and folding means arranged to cooperate with each of a succession of said preshaped pieces to rapidly fold the peripheral flaps thereof, and said folding means further comprising an upstanding abutment at one transverse side of the slide surface and a fixed plate at the other transverse side of the slide surface and substantially coplanar therewith to underlie and support the preshaped pieces, the fixed plate being disposed at one of said predetermined positions and having an inner edge adjacent the slide surface and an outer edge remote from the slide surface and extending in the direction of feeding, said outer edge precisely underlying the fold line of each preshaped piece when another peripheral portion of the piece engages the upstanding abutment, said abutment being elongate and extending in the direction of feeding, said folding means also including a folding rod adjacent the outer edge of the fixed plate, the rod lying substantially horizontally and extending perpendicular to said feed direction, first operating means operable in coordinated relation to said feed means to move said rod in a substantially axial direction between a rest position spaced from said plate and edge and a working position in which an end portion of said rod is in lapped relation with the fixed plate and positioned below said plate, and mobile flexing means for fixing each preshaped piece in said predetermined position against said fixed plate and against the abutment during the folding of the flap, and the folding rod extends generally horizontally, said first and second operating means comprise an articulated parallelogram disposed in a plane substantially perpendicular to the direction of feeding, and comprising first and second rocker arms with means pivotally connecting to the folding rod, said arms being hinged to a substantially vertical connecting rod rigid with a fixed frame, a pair of coordinated rotary cams each producing the entire rocking movement of a respective rocker arm, said second rocker arm supporting said rod and moving the rod in the axial direction into and out of lapped relation with the fixed plate, and said first rocker arm moving the rod transversely of itself and above and below the fixed plate.

2. A device as claimed in claim 1, wherein said two cams are keyed onto a rotatable shaft connected in coordinated relation with said intermittently operating feed means.

3. A device for rapidly manipulating a succession of cardboard workpieces to precisely fold a peripheral flap of each workpiece along a predetermined fold line, comprising an intermittently operating conveyor moving the succession of cardboard workpieces in horizontal orientation to and past a folding station and allowing each of the workpieces to stop at the folding station, a fixed plate at one side of the conveyor at the folding station to underlie the workpiece and having a fixed edge parallel to the conveyor movement to underlie the fold line of the workpiece, there being an unobstructed space transversely of said fixed edge and therebelow through which the flap of the workpiece may be moved and folded, an elongate upright workpiece orienting abutment at the folding station and disposed at a second side of the conveyor opposite to the location of the fixed plate, an oscillating folding element at the folding station and adjacent the fixed plate, the folding element having an upright pusher face confronting the fixed edge of the plate and also confronting the upright abutment for engaging the edge of the workpiece flap and urging the workpiece transversely of the conveyor and against the abutment to be thereby oriented with the fold line at said fixed edge, the folding element also having an end projecting substantially horizontally toward the plate and having a downwardly facing folding face to confront the flap of the workpiece and urge the flap downwardly to produce the fold thereof along the fold line and over the fixed edge of the plate, camming means moving the folding element in coordinated relation to the conveyor wherein the folding element is held in rest position while the conveyor is moving and is moved while the conveyor is stationary to accomplish workpiece alignment and folding of the flap, said camming means initially incrementally moving the folding element horizontally toward the fixed plate to cause the pusher face to thrust and orient the workpieces against the abutment, and secondly, moving the folding element downwardly through the plane of the fixed plate and through the unobstructed space to cause the folding face to engage and commence folding of the flap about the fixed edge of the plate, and thirdly, moving the folding element further through the unobstructed space and beneath and into lapped relation with the fixed plate and therebelow to swing the flap beneath the fixed plate and thereby sharply crease the workpiece at the fixed edge, and fourthly, returning the folding element out of lapped relation to the plate and upwardly through the unobstructed space to rest position, and means clamping the workpiece onto the fixed plate during movement of the folding element and thereafter releasing the workpiece.

* * * * *